United States Patent [19]

Shy

[11] Patent Number: 5,002,321

[45] Date of Patent: Mar. 26, 1991

[54] DOOR LOCK WITH LIGHTLY-CLOSING FORCE

[76] Inventor: Haw-Yaw Shy, P.O. Box 55-1670, Taipei, Taiwan

[21] Appl. No.: 532,619

[22] Filed: Jun. 4, 1990

[51] Int. Cl.[5] ..... E05C 1/16

[52] U.S. Cl. ..... 292/335

[58] Field of Search ..... 292/191, 192, 335

[56] References Cited

U.S. PATENT DOCUMENTS

| | | | |
|---|---|---|---|
| 203,787 | 5/1878 | Smith | 292/191 |
| 221,261 | 11/1879 | Wimmer | 292/191 |
| 1,662,449 | 3/1928 | Zubow | 292/335 |
| 2,162,929 | 6/1939 | Armstrong | 292/335 |
| 2,322,817 | 6/1943 | Borchers | 292/191 X |
| 4,576,405 | 3/1986 | Wartian | 292/191 |

*Primary Examiner*—Richard E. Moore

[57] ABSTRACT

A door lock includes a lock body mounted in a door having a main latch operatively extended outwardly to be locked into a locking socket of a door frame and a biasing plate pivotally formed in an outer portion of the lock body and the door of which the biasing plate is normally resiliently biased clockwise as restored by a restoring spring to extend the plate outwardly to allow a protrusion formed on the plate for engaging a recess formed in the main latch for locking the main latch at its retraction state when opening the door, whereby upon a pushing of the door to allow the door frame to first depress the biasing plate inwardly with a lighter force to disengage the protrusion of the biasing plate from the recess of the main latch, the main latch will be extended as urged by its own main restoring spring to completely close the door on the door frame.

2 Claims, 2 Drawing Sheets

DOOR LOCK WITH LIGHTLY-CLOSING FORCE

BACKGROUND OF THE INVENTION:

A conventional door lock as shown in FIG. 1 may include a latch L for locking the door D on a door frame F which latch L is generally formed with a sloping surface for a smooth closing operation of the door. However, when such a door lock is used in a door provided with an automatic door closer either hydraulic operated or spring loaded may not be completely closed because the closing force acted by the automatic door closer may be not enough to retract the latch L bearing against the strong spring force acting on the latch L, thereby unable to completely close the door by engaging the latch L with the socket S as shown in dotted line in FIG. 1.

As shown in FIG. 1A, a recently developed door lock having a retractor RT sandwiched between a pair of latches L as shown in the figure is provided to enforce a door closing operation as effected by an automatic door closer, for instance, by overcoming a spring restoring force acting on the latches, which however still requires a closing force equal to the restoring force by the latch spring and does not substantially save the door closing force.

The present inventor has found the drawback of the conventional door lock and invented the present door lock with lightly-closing force.

SUMMARY OF THE INVENTION

The object of the present invention is to provide a door lock including a lock body mounted in a door for operatively extending a main latch outwardly for locking the door in a door frame or retracting the latch for opening the door, and a latch-extending starter which is resiliently extended outwardly for locking the main latch at its retracted state when opening the door and is operatively depressed inwardly to unlock the main latch to extend the latch outwardly to be locked on the door frame, so that the door can be closed with a lighter closing force by first actuating the starter which will in turn immediately extend the main latch to lock the door onto the frame.

DETAILED DESCRIPTION

Figure 1:
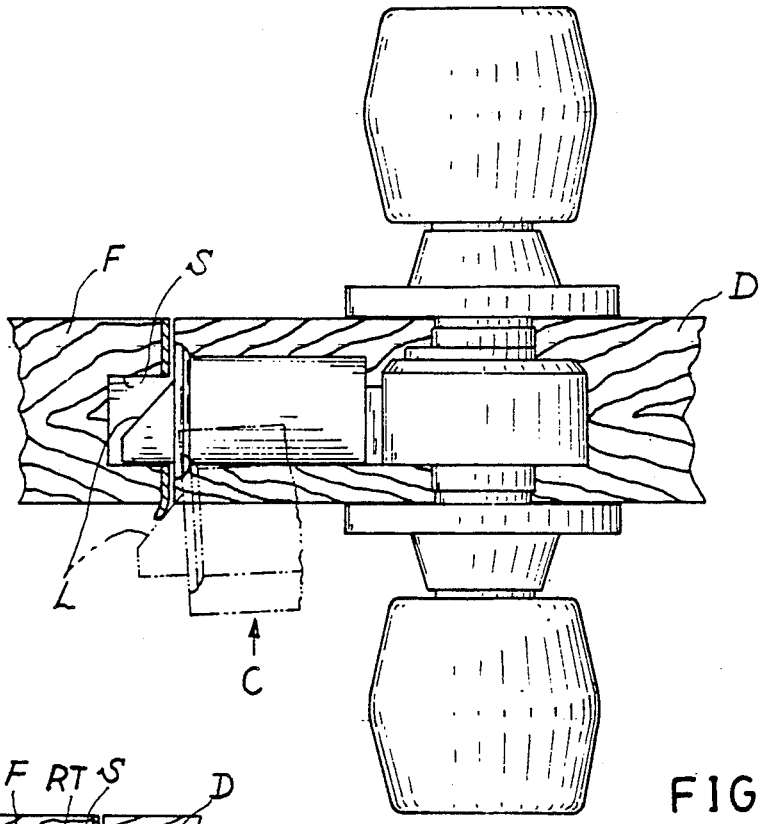
FIG. 1 PRIOR ART
FIG. 1 is an illustration showing a conventional door lock.
Figure 1A:
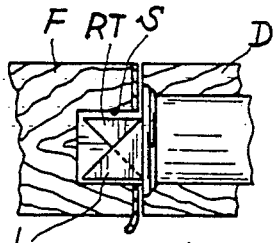
FIG. 1A PRIOR ART
FIG. 1A shows another conventional door lock.

As shown in FIGS. 2–6, the present invention comprises: a lock body 1 mounted in a door 10 having an outside knob 11 and an inside knob 11′ respectively formed on an outside O and an inside I of the door 10, a latch-extending starter 3 pivotally secured in an outer portion of the lock body 1, and a main latch 2 operatively extended to engage a locking socket 41 formed in the door frame 4 for closing the door 10 to the door frame 4.

Figure 2:
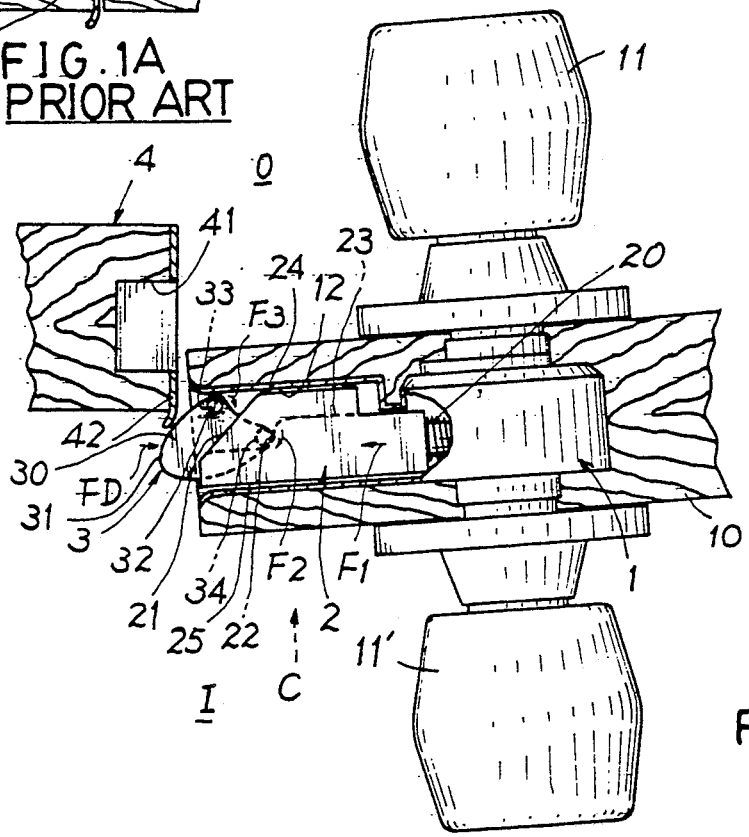
FIG. 2 is a top-view illustration of the present invention.
Figure 3:
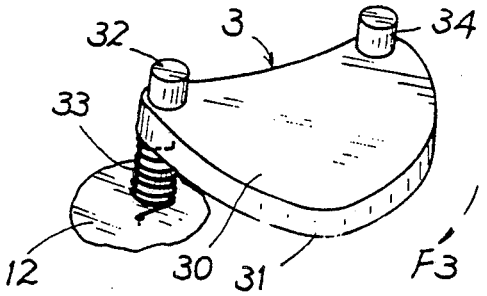
FIG. 3 is a perspective view of the latch-extending starter of the present invention.

The latch-extending starter 3 includes a triangular plate 30 having a sloping surface portion 31 on its outer portion, a pivot 32 pivotally securing a central apex portion of the plate 30 on a socket 12 of the lock body 1, a restoring spring 33 disposed around the pivot 32 for normally restoring the plate 30 clockwise F3 to extend the sloping surface portion 31 outwardly as shown in FIGS. 3 and 2, and a stopping protrusion 34 formed on an inner portion of the plate 30.

Figure 4:
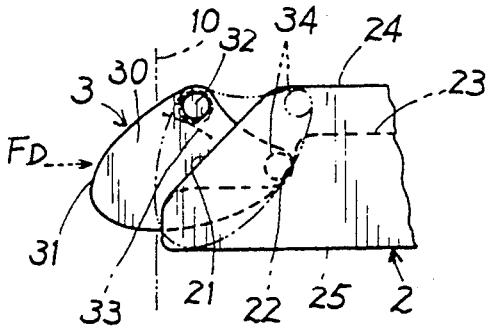
FIG. 4 shows the main latch locked by the starter in accordance with the present invention.
Figure 5:
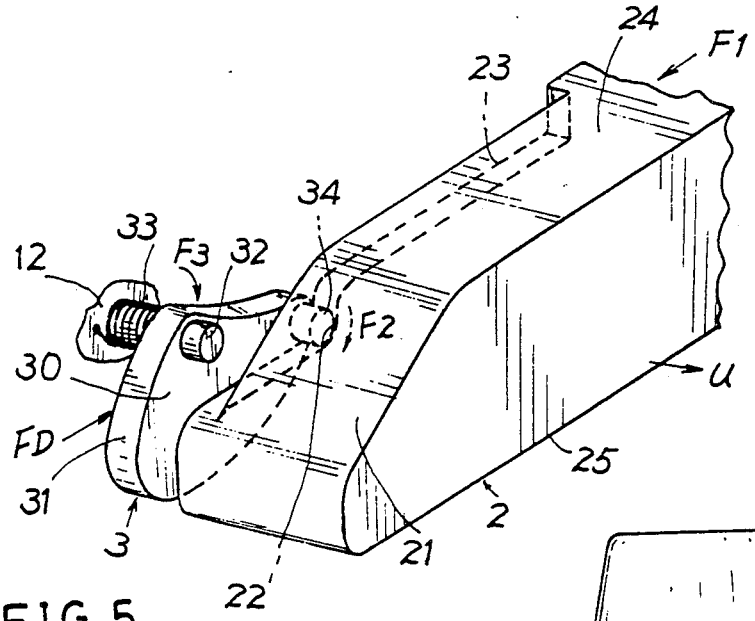
FIG. 5 is a perspective view showing the latch in cooperation with the starter in accordance with the present invention.
Figure 6:
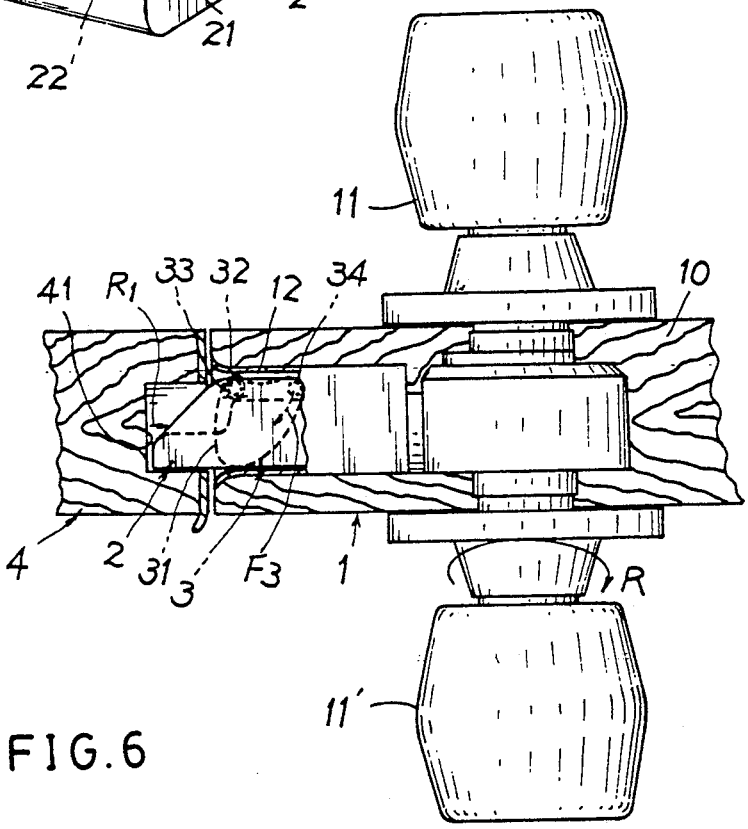
FIG. 6 is an illustration showing a closed state of the present invention.

The main latch 2 reciprocatively held in a socket 12 of lock body, includes: a sloping head portion 21 formed on its outer portion, a right-angle recess portion 22 formed in an outer portion of the latch approximate to the sloping head portion 21 as recessed from a longitudinal groove 23 formed in a first surface 24 of the latch 2 on the outside O of door 10 opposite to a second surface 25 facing the inside I of the door 10, and a main restoring spring 20 normally urging the latch 2 outwardly. In FIG. 5, the direction U indicates an upside of the orientation of the latch 2. As shown in FIGS. 2, 4, 6, such a groove 23, recess portion 22 are formed in a bottom portion of the latch 2. The starter 3 is generally positioned under the main latch 2.

In using the present invention, when the door 10 is opened as shown in FIG. 2 the starter 3 is resiliently extended outwardly to bias the protrusion 34 clockwise F3 to engage the recess portion 22 of the main latch 2 to thereby retract the main latch 2 at its retracted state.

When the door 10 is closed in direction C from FIG. 2 to FIG. 6 operated by someone or acted by an automatic door closer either hydraulic operated or spring loaded, the sloping-surface portion 31 of the starter 3 when impacted on the metallic guide plate 42 fixed on the door frame 4 will be depressed (FD) to bias the protrusion 34 counter-clockwise so as to disengage the recess portion 22 of the main latch 2. At this time, the door 10 is facing the door frame 4 and the restoring spring 20 will urge the latch 2 outwardly to engage the locking socket 41 formed in the frame 4, thereby closing the door 10 on the door frame 4 as shown in FIG. 6.

The depression force FD acting on the sloping-surface portion 31 of the starter 3 should overcome a friction force F2 between the protrusion 34 and the recess portion 22 of the latch 2 as urged by the spring 20 and a spring force F3 acted by the small restoring spring 33 disposed on the pivot 32 of the starter 3. Since the spring force F3 is quite small in comparison with the restoring force by the main spring 20 of the latch 2. Also, the friction force F2 between the recess portion 22 and the protrusion 34 may be greatly reduced by selecting a suitable material for minimizing its friction coefficient. For instance, a suitable plastic material such as teflon may be selected to minimize the material friction force so that the friction force F2 will then be greatly reduced. Therefore, the depression force FD required to overcome the spring restoring force F3 (which is greatly smaller than the spring force of latch spring 20) and the friction force F2 (which is minimized by selecting optimum material of low friction coefficient as above-mentioned) to bias the starter 3 to disengage the protrusion 34 from recess portion 22 in order to extend the latch 2 for closing the door 10 will then be greatly reduced especially in comparison with a greater force required to retract a conventional latch L as shown in FIG. 1. The depression force FD required to disengage the starter 3 from the latch (recess 22) is relatively small so that a lighter door closing force is required in this invention. Even an automatic door closer with lightly closing force of U.S. Pat. No. 4,756,051 as disclosed by the same applicant of this invention may close the door completely to the door frame in accordance with the present invention.

The present invention may be utilized in a cylinder lock, a mortise lock, a deadlock and other door locks wellknown in the art and is not limited.

When opening the door of the present invention from FIG. 6 to FIG. 2, the knob 11 or 11' is rotated (R) to retract the main latch 2 to allow the protrusion 34 of the starter 3 sliding on the longitudinal groove 23 until the protrusion 34 is engaged with the recess portion 22 of the latch 2 when the door is being opened because the protrusion 34 of the starter 3 is always resiliently restored clockwise (F3) ready for engaging the recess portion 22. The starter 3 is then positioned as shown in FIG. 2 to extend the sloping-surface portion 31 ready for next door-closing operation and the latch 2 is locked at its retraction state.

The present invention is superior to a conventional lock because the latch-extending starter 3 may render a "catalyst" effect to initiate the extension of the main latch with a lighter force so as for ensuring a complete door closing operation by human force or by an automatic door closer.

I claim:

1. A door lock comprising:

a lock body mounted in a door having a main latch operatively extended to engage a latch socket formed in a door frame for closing the door on the door frame as urged by a main restoring spring formed in said lock body; and a latch-extending starter pivotally formed in an outer portion of the lock body in the door, the improvement which comprises: said latch-extending starter including a sloping-surface portion formed on an outer portion of said starter, a pivot for pivotally securing a central apex portion of the starter in a socket of the main latch of the lock body, a restoring spring disposed around the pivot for resiliently biasing the starter clockwise for normally extending the sloping surface portion outwardly, and a protrusion formed on an inner portion of the starter;

said main latch having a recess portion recessed from a longitudinal groove formed on a bottom portion of said latch to be operratively engaged with the protrusion of said starter, whereby upon a pushing of the door to its closing state to allow the door frame to depress the starter inwardly to disengage the protrusion of the starter from the recess portion of the main latch, the main restoring spring will urge the main latch outwardly in order to lock the main latch into a locking socket in the door frame, thereby locking the door with a lighter closing force.

2. A door lock according to claim 1, wherein said latch-extending starter is positioned under said main latch and is generally formed as a triangular plate.

* * * * *